United States Patent [19]

Shimoma et al.

[11] Patent Number: 4,786,842

[45] Date of Patent: Nov. 22, 1988

[54] RESISTOR ASSEMBLY

[75] Inventors: Taketoshi Shimoma, Isesaki; Eiji Kamohara, Fukaya; Takahiro Hasegawa, Gyoda, all of Japan

[73] Assignee: Kabushiki Kaisha Toshiba, Kawasaki, Japan

[21] Appl. No.: 89,940

[22] Filed: Aug. 25, 1987

Related U.S. Application Data

[63] Continuation of Ser. No. 736,371, May 21, 1985, abandoned.

[30] Foreign Application Priority Data

May 24, 1984 [JP] Japan ..... 59-103618
Dec. 20, 1984 [JP] Japan ..... 59-267346

[51] Int. Cl.[4] ..... H01J 23/16

[52] U.S. Cl. ..... 315/3; 313/449; 313/450; 313/456; 313/417; 315/52

[58] Field of Search ..... 315/3, 52; 313/449, 313/450, 456, 457, 452, 52, 414; 338/290, 283, 287, 288, 289

[56] References Cited

U.S. PATENT DOCUMENTS

| | | | |
|---|---|---|---|
| 3,722,084 | 3/1973 | Caddock | 264/277.18 |
| 3,932,786 | 1/1976 | Campbell | 315/3 |
| 4,143,298 | 3/1979 | Bing et al. | 313/450 |
| 4,255,689 | 3/1981 | Fischman et al. | 315/3 |
| 4,328,466 | 5/1982 | Norris et al. | 315/3 |
| 4,349,767 | 9/1982 | Muramoto et al. | 315/3 |

FOREIGN PATENT DOCUMENTS

| | | | |
|---|---|---|---|
| 85106366 | 9/1987 | European Pat. Off. . | |
| 0050747 | 3/1982 | Japan | 315/3 |
| 0082944 | 5/1982 | Japan | 315/3 |
| 0102445 | 6/1983 | Japan | 315/3 |

*Primary Examiner*—Leo H. Boudreau
*Assistant Examiner*—Michael Razavi
*Attorney, Agent, or Firm*—Cushman, Darby & Cushman

[57] ABSTRACT

A resistor assembly built into an electron tube, comprising a resistor element having at least one hole, an inner connector fitted in the hole, and an outer connector which formed integrally with the inner connector, or fixed thereto. The inner connector is electrically connected to the resistor element. The outer connector is secured and electrically connected to a part in the electron tube, whereby the resistor element is electrically connected to said part.

2 Claims, 4 Drawing Sheets

RESISTOR ASSEMBLY

This is a continuation of application Ser. No. 736,371, filed May 21, 1985 which was abandoned upon the filing hereof.

BACKGROUND OF THE INVENTION

I. Field of the Invention

The present invention relates to a resistor assembly which is built into an electron tube.

II. Description of the Prior Art

Generally, a cathode ray tube such as a color picture tube requires a medium voltage of about 5 kv to 8 kv, which is applied as a focussing voltage to an electron gun, in addition to a high anode voltage of about 25 kv to 35 kv. Further, in a mask-focussing type color picture tube, a high voltage which is slightly lower than the high anode voltage must be applied to a shadow mask. Where a high or medium voltage is supplied to the tube from outside the same, the voltage supply part of the tube needs to have a high withstand voltage. For this reason, various inconveniences such as complication in structure of the voltage supply part occur.

To eliminate these inconveniences, it has been proposed to provide a resistor in a cathode ray tube, dividing the high anode voltage, thereby obtaining and applying a specified high or medium voltage to a specified electrode. This technique is described in Japanese Utility Model Disclosures Nos. Sho 48-21561, and Sho 55-38484, Japanese Utility Model Publication Sho 59-7723, and U.S. Pat. Nos. 3,932,786 and 4,143,298.

The above-mentioned resistor is supported and connected to the electrodes by wires or elastic members. The electrical connection is sometimes defective, or the mechanical strength with which the resistor is mounted is sometimes insufficient. Further, the voltage withstand characteristics are sometimes deteriorated. Thus, the reliability is low.

SUMMARY OF THE INVENTION

Accordingly, the object of the present invention is to provide a reliable resistor assembly which does not have the above-mentioned problems, in which a resistor is easily and reliably supported and electrically connected to a specified part in an electron tube involved, and which is to be built into the electron tube.

The resistor assembly of the present invention comprises a resistor element having at least one hole, an inner connector fitted in the hole and electrically connected to the resistor element, and an outer connector integrally formed with or fixed to the inner connector. The resistor assembly is built into an electron tube. The outer connector is secured and electrically connected to a part in the electron tube, whereby the resistor element is electrically connected to said part.

The hole in the resistor element may be a through hole or a depression.

The part to be electrically connected to the resistor element may be a grid or electrode constituting an electron gun of the cathode ray tube, or may be a shadow mask of a mask focussing-type color picture tube.

In the resistor assembly of the present invention, the resistor can be easily and reliably supported and electrically connected to a specified part in the electron tube.

DETAILED DESCRIPTION OF THE PREFERRED EMBODIMENTS

Various preferred embodiments of the invention will now be described with reference to the appended drawings.

Figure 1:
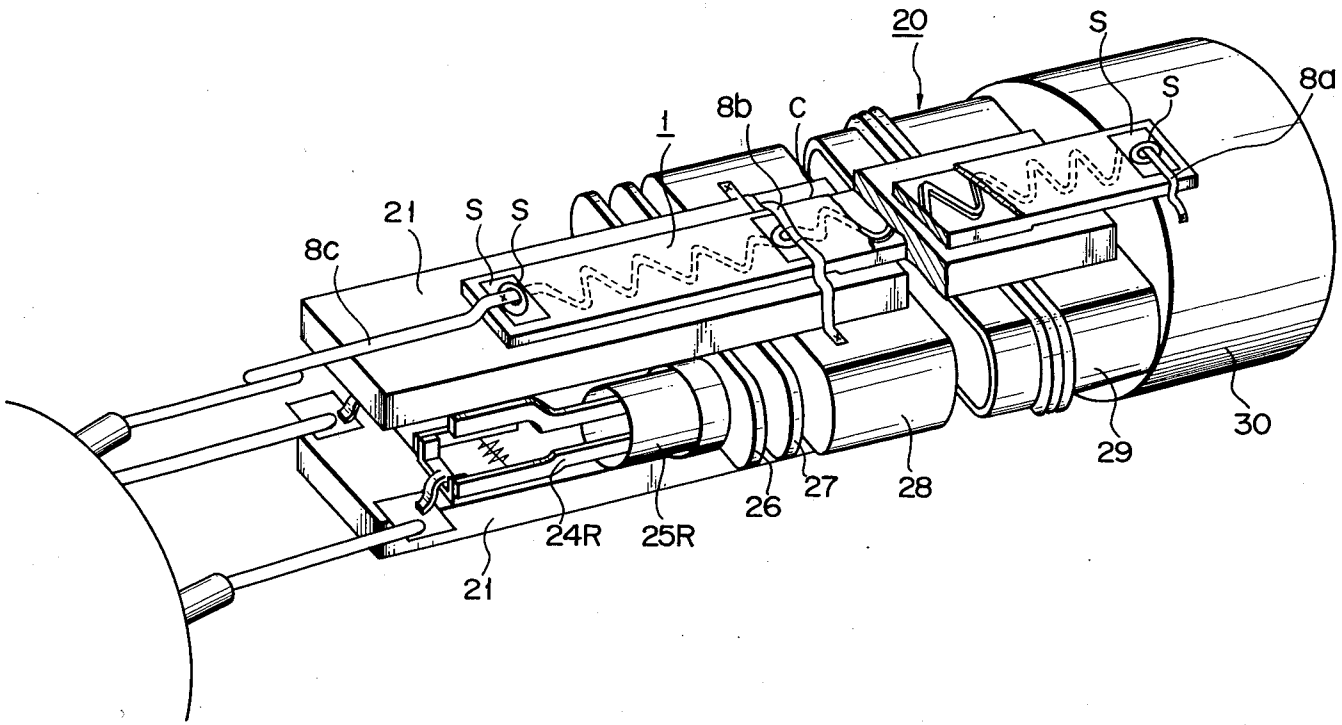
FIG. 1 is a perspective view of an electron gun assembly with a resistor assembly of the invention incorporated in it.
Figure 2:
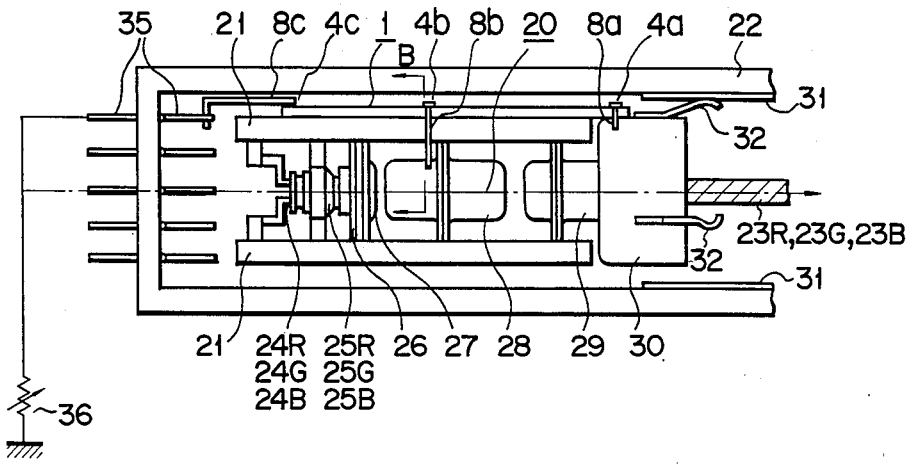
FIG. 2 is a sectional view showing the electron gun assembly of FIG. 1 received in a neck portion of a cathode ray tube.

FIG. 1 is a perspective view of an electron gun assembly in which a resistor assembly of the invention is incorporated, and FIG. 2 is a sectional view of said electron gun assembly received within a cathode ray tube.

In FIGS. 1 and 2, an electron gun 20 has a plurality of electrodes (later described) and a pair of insulating supports 21 for supporting those electrodes. As shown in FIG. 2, this assembly 20 is received within a neck portion 22 of the cathode ray tube. The electrodes are constituted by cathodes 25R, 25G and 25B (in FIG. 1, the cathode 25 R alone is shown) arranged in line, and a first grid 26, second grid 27, third grid 28, fourth grid 29 and convergence electrode 30. The electrodes have electron beam passages (not shown) at the positions corresponding to those cathodes respectively, and are assembled into a unitized structure. They are fixedly supported on insulating supports 21 in the order mentioned. The cathodes 25R, 25G and 25B contain heaters 24R, 24G and 24B (in FIG. 1, the heater 24R alone is shown) and emit electron beams 23R, 23G and 23B, respectively. The electron beams 23R, 23G and 23B impinge upon red-emitting phosphor, green-emitting phosphor and blue-emitting phosphor (not shown) formed on a screen, not shown. The convergence electrode 30 is provided with bulb spacers 32. A high voltage of about 25 kv is applied to an anode terminal (not shown) via the bulb spacers 32 and an inner conductive film 31. A resistor assembly is mounted on the insulating support 21 by ribbon-like outer connectors 8*a*, 8*b* and 8*c* constituting parts of the resistor assembly 1. These connectors electrically connect the resistor assembly 1 to specified parts of the electron gun assembly.

Figure 3:
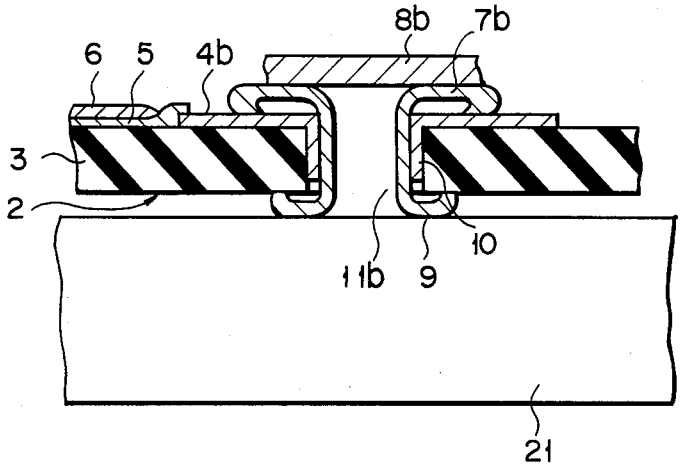
FIG. 3 is a sectional view showing a connector which can be used in the resistor assembly of the invention.

A detailed description will now be made of the resistor assembly with reference to FIGS. 1 to 3. FIG. 3 is a sectional view of a connector structure for connecting the resistor assembly to the third grid. The resistor assembly 1 comprises a resistor element 2 which is a strip having a specified length and has through holes 11*a*, 11*b* and 11*c* at its edge portions S and its center portion C, inner connectors 7*a*, 7*b* and 7*c* (7*a* and 7*c* are not shown) which are inserted in the through holes 11*a*, 11*b* and 11*c* and fixed and electrically connected to the resistor element 2, and outer connectors 8*a*, 8*b* and 8*c* which are fixed and electrically connected at one end to a corresponding inner connector 7*a*, 7*b* or 7*c* and secured and electrically connected at the other end to specified parts of the electron gun. The resistor element 2 is electrically connected to stem pins 35, the third grid 28 and convergence electrode 30 by the inner connectors *7a, 7b* and *7c* and the outer connectors *8a, 8b* and *8c*, respectively.

The resistor element 2 is comprised of a ceramic substrate 3 5.0 mm wide, 1.0 mm thick, and 60 mm long, which has through holes 11*a*, 11*b* and 11*c* at its end portions and its center portion, a high resistance layer 5 formed on the substrate 3, conductive layers 4*a*, 4*b* and 4*c*, and an insulating layer 6 which is formed on the high resistance layer 5. The layer 5 is formed of a material having ruthenium oxide as its main component and mixed with glass, and has a resistance of about 500 mΩ. Layers 4*a*, 4*b* and 4*c* extend from the high resistance layer to the inner wall of the through hole 11*a*, 11*b* or 11*c*, and are made of a material having ruthenium oxide as its main component and which have a resistance of several kΩ.

For example, an eyelet metal ring shown in FIG. 3 can be used as the inner connector *7a, 7b* or *7c*. In this case, the ring is inserted into the through hole 11*a*, 11*b* or 11*c* and pressed from above and below and is deformed at its upper and lower ends, hence fixed to the ceramic substrate 3. Further, the ring is electrically connected to the conductive layer 4*a*, 4*b* or 4*c*.

The outer connector *8a, 8b* or *8c* is, for example, a metal strip. Its one end or center portion (FIG. 1), is secured to an upper flat portion of the inner connector *7a, 7b* or *7c* while its another part i.e., its one end or both ends are secured to a specified member, such as the stem pin 35, third grid 28 or convergence electrode 30. As a result, the resistor element 2 is reliably mounted in the electron gun assembly and is electrically connected to the specified member or parts. The reference numeral 36 denotes a variable resistor which is connected to the stem pin.

Figure 4:
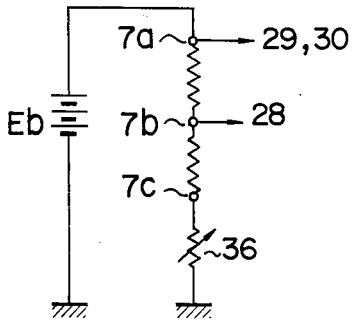
FIG. 4 shows an electric circuit containing the resistor assembly of the present invention.

As stated above, the resistor element 2 is reliably incorporated in the electron gun and operates as an electronic circuit element with high reliability. The electronic circuit concerned therewith is shown in FIG. 4. As shown an anode high voltage Eb of about 25 kv is applied to the convergence electrode 30 while a voltage of about 8 kv is applied to the third grid 28 due to the voltage drop caused by the resistance of the resistor element.

Figure 5:
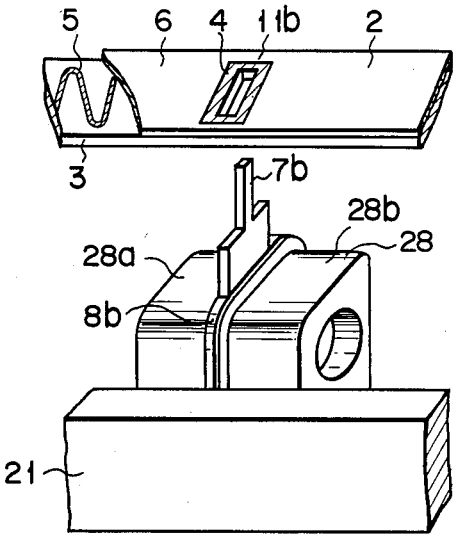
FIGS. 5 to 8 show various connectors that can be used in the resistor assembly of the present invention.

In the example described hereinabove, the outer connectors *8a, 8b*, and *8c* were welded to the inner connectors *7a, 7b*, and *7c*. As shown in FIG. 5, the outer connector *8b* and inner connector *7b* may be formed integrally with each other. In this case, the outer connector portion *8b* is sandwiched between a pair of electrodes 28*a* and 28*b* constituting the third grid when an electron gun involved is assembled. These inner and outer connector portions *7b* and *8b* are supported on, and electrically connected to, the resistor element 2 by inserting the inner connector portion *7b*, which is shaped in conformity with the through hole 11*b*, into this hole 11*b*, and then bending or twisting into the shape of L or U that fore end portion of the inner connector portion *7b* protruding upwards from the through hole 11*b*.

Figure 6:
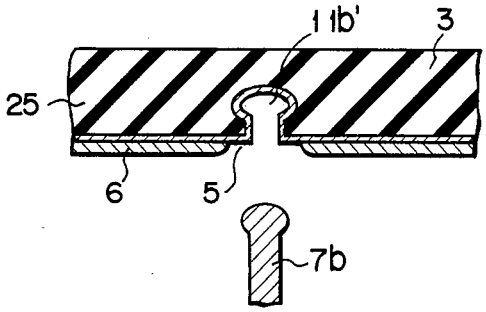

The electrical connection and mechanical mounting of the connector portions to the resistor element 2 may also be effected in the following manner. FIG. 6 shows this another example. A recess 11*b'* is cut in the substrate 3 and the fore end portion of the inner connector portion *7b* is shaped like a ball so as to conform to the shape of the recess 11*b'*. This fore end portion is fitted into the recess 11*b'* for electrical connection and mechanical mounting of the connector portions to, and on, the resistor element. In this case, the high resistance layer 5 is formed, extending over the inner surface of the recessed portion 11*b'*.

Figure 7:
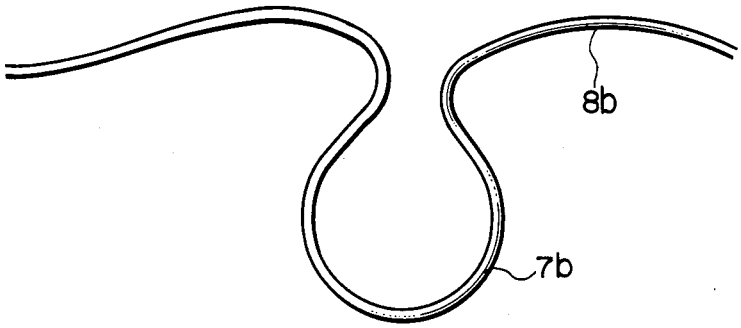

The single wire shown in FIG. 7 may be used as a connector having a simple structure. In this case, a inner connector portion *7b*, which is bent in a circular manner, may be fitted into the through hole 11*b*, or the recess 11*b'* and the outer connector portion *8b* may have its end portion welded onto the third grid 28, whereby the resistor element can be fixed to the electron gun assembly by the elastic force of the wire.

Figure 8:
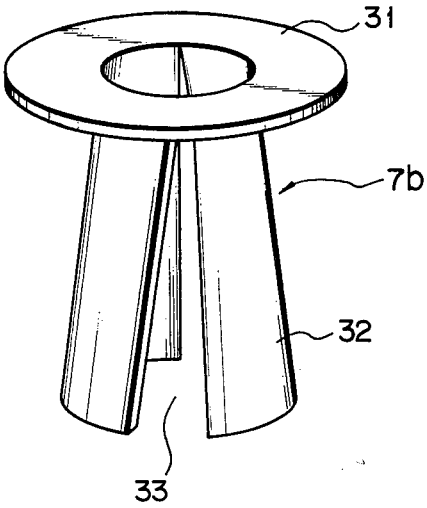

Further, the inner connector *7b* may be made into a structure shown in FIG. 8 which consists of a flange portion 31 and leg portions 32. These leg portions 32 are formed by making a pair of cuts 33 in a cylindrical body formed of a resilient material and widening the cuts through a specified angle respectively. These leg portions 32 may be fitted into the through hole 11*b* or recess 11*b'*, whereby the inner connector *7b* can be fixed to the resistor element by utilizing the elastic force of the leg portions 32. In this case, the outer connector may be constituted by a strip or wire and be welded to the flange portion 31.

Various examples of the inner and outer connectors *7b, 8b* for applying a medium voltage, which has been obtained by dropping the high anode voltage owing to the resistance of the resistor element, to the third grid 28 have been described above. These connectors, however, may also be used as the connectors *7a, 8a* and *7c, 8c* for connecting the resistor element and the convergence electrode or connecting the resistor element and the stem pins.

In the foregoing description, reference has been made to the resistor assembly used for applying a specified voltage to the grid or electrode of an electron gun used in the color picture tube. The present invention, however, is not limited to this, but may be also applied to a resistor which is disclosed in U.S. Pat. No. 4,345,185 and which is used for preventing the occurrence of spark current. Furthermore, the invention can also be applied to a resistor used for applying a mask voltage to a shadow mask of a mask-focussing type color picture tube.

What is claimed is:

1. A cathode ray tube provided with an electron gun assembly and an anode, said electron gun assembly having electron beam generating means, a plurality of electrodes for focusing said electron beam on said anode, a plurality of insulating supports for supporting said electrodes on one surface of each said insulating support, and a resistor assembly comprising:

an insulating substrate, a resistor element formed on said insulating substrate and electrically connected to said anode, a plurality of terminals for applying voltages divided from an anode voltage to said electrodes, a metal member formed of a structure from the group consisting of metal wire and metal ribbon, wherein said insulating substrate has at least two through holes and a metal tube which is fixed to said insulating substrate and electrically connected to said resistor element by inserting said metal tube into said through hole and deforming upper and lower end portions thereof by pressure, wherein one end of said metal member is fixed to said upper deformed portion of said metal tube, and said resistor assembly being mounted on at least one other surface of said insulating supports by fixing the other end of said metal member to said electrodes.

2. A method of assembling a resistor assembly for a cathode-ray tube, comprising the steps of:

providing a resistor assembly which has an insulating substrate and a resistor element on the insulating substrate electrically connected to an anode of said cathode-ray tube, said insulating substrate having at least two through holes;

fitting a metal tube into the through hole, by inserting said tube into said through hole;

deforming upper and lower end portions of said tube by pressure to electrically connect said metal tube to said resistor element;

connecting one end of a metal member which is a wire or a metal ribbon to said upper portion of said metal tube which has been deformed; and connecting the other end of said metal member to said cathode-ray tube.

* * * * *